US005255780A

United States Patent [19]

Olsen

[11] Patent Number: 5,255,780

[45] Date of Patent: Oct. 26, 1993

[54] CARRIER STOCK WITH TEAR-OPEN TABS

[75] Inventor: Robert C. Olsen, Medinah, Ill.

[73] Assignee: Illinois Tool Works Inc., Glenview, Ill.

[21] Appl. No.: 977,808

[22] Filed: Nov. 17, 1992

[51] Int. Cl.[5] ..... B65D 75/58

[52] U.S. Cl. ..... 206/150

[58] Field of Search ..... 206/150, 151

[56] References Cited

U.S. PATENT DOCUMENTS

| | | | |
|---|---|---|---|
| 2,997,169 | 8/1961 | Poupitch | 206/150 |
| 3,038,602 | 6/1962 | Rapata | 206/150 |
| 3,084,792 | 4/1963 | Poupitch | 206/150 |
| 3,086,651 | 4/1963 | Poupitch | 206/150 |
| 3,504,790 | 4/1970 | Owen | 206/150 |
| 3,721,337 | 3/1973 | Braun et al. | 206/150 |
| 4,018,331 | 4/1977 | Klygis | 206/199 |
| 4,064,989 | 12/1977 | Olsen | 206/428 |
| 4,925,020 | 5/1990 | Gordon | 206/150 |
| 5,016,750 | 5/1991 | Gordon | 206/150 |
| 5,020,661 | 6/1991 | Marco | 206/150 |
| 5,038,928 | 8/1991 | Marco et al. | 206/162 |
| 5,072,829 | 12/1991 | Marco et al. | 206/150 X |
| 5,115,910 | 5/1992 | Klygis et al. | 206/150 |
| 5,139,137 | 8/1992 | Marco | 206/150 |
| 5,174,441 | 12/1992 | Marco | 206/150 |
| 5,178,266 | 1/1993 | Villa | 206/150 |
| 5,193,673 | 3/1993 | Rathbone et al. | 206/150 |
| 5,209,346 | 5/1993 | Pratt et al. | 206/150 |

*Primary Examiner*—William I. Price

*Attorney, Agent, or Firm*—Dressler, Goldsmith, Shore, Sutker & Milnamow, Ltd.

[57] ABSTRACT

Carrier stock formed from a single sheet of resilient polymeric material, such as low density polyethylene, for machine application to substantially identical containers. The stock is severable to form individual carriers with three longitudinal rows of container-receiving apertures, as defined by integrally joined band segments, which include generally longitudinal outer band segments and generally diagonal inner band segments. One of the band segments defining each container-receiving aperture has a tear-open tab. The band segments having tear-open tabs include a specified subgroup of the diagonal inner segments and either the longitudinal outer segments, in a first embodiment, or an additional subgroup of the diagonal inner segments, in a second embodiment. Each band segment having a tear-open tab has slits to facilitate tearing of such band segment when the tear-open tab is pulled.

8 Claims, 1 Drawing Sheet

CARRIER STOCK WITH TEAR-OPEN TABS

TECHNICAL FIELD OF THE INVENTION

This invention pertains to carrier stock for machine application to substantially identical containers. The carrier stock is severable to form individual carriers with separate apertures to receive the individual containers. Certain aperture-defining band segments including certain band segments extending in generally diagonal directions when the carrier stock is unstressed have tear-open tabs to enable the individual containers to be easily removed.

BACKGROUND OF THE INVENTION

Typically, carrier stock with individual container-receiving apertures for machine application to substantially identical containers is formed, as by die-cutting, from a single sheet of resilient polymeric material, such as low density polyethylene. A recent example of carrier stock with tear-open tabs is disclosed in Marco U.S. Pat. No. 5,020,661, which discloses two longitudinal rows of container-receiving apertures.

As disclosed in the Marco patent noted above, the container-receiving apertures are arranged in two longitudinal rows and are defined by band segments, which include outer band segments extending in generally longitudinal directions when the carrier stock is unstressed. Each outer band segment has a tear-open tab and is slitted to facilitate tearing of such outer band segment when the tear-open tab is pulled.

An earlier example of carrier stock with tear-open tabs is disclosed in Olsen U.S. Pat. No. 4,064,989, which also discloses two longitudinal rows of container-receiving apertures. As disclosed therein, outer band segments have tear-open tabs, each having a slit at an acute angle to a line drawn at its base.

A different approach to providing carrier stock with tear-open capability, via elements attaching band segments to pull-tab rings on the containers, is disclosed in Gordon U.S. Pat. No. 5,016,750, which also discloses two longitudinal rows of container-receiving apertures.

Carrier stock with container-receiving apertures arranged in three longitudinal rows is known, as exemplified in Klygis U.S. Pat. No. 4,018,331. This patent does not teach tear-open capability.

SUMMARY OF THE INVENTION

This invention provides an improvement in carrier stock formed from a single sheet of resilient polymeric material, such as low density polyethylene, for machine application to substantially identical containers. The improvement is useful where the container-receiving apertures are arranged in two or more longitudinal rows, and where the band segments defining the container-receiving apertures include generally diagonal band segments, each of which extends in a generally diagonal direction when the carrier stock is unstressed. Broadly, this invention contemplates that some of the generally diagonal band segments have tear-open tabs.

Specifically, this invention also contemplates that, where the longitudinal rows include two outer rows and an inner row, the generally diagonal band segments having tear-open tabs may include one of the band segments defining each respective one of the container-receiving apertures of the inner row.

In a first contemplated embodiment, which contemplates that the band segments include outer band segments extending in generally longitudinal directions when said stock is unstressed, each outer band segment has a tear-open tab.

Preferably, in the first contemplated embodiment, the container-receiving apertures of each carrier define a rectangular array having two shorter sides and two longer sides, each shorter side being comprised of two such apertures, and each longer side being comprised of a larger number of such apertures. Two of the tear-open tabs may be thus accessible from each of the shorter sides, and wherein each of the remaining tear-open tabs is accessible from one of the longer sides.

In a second contemplated embodiment, the generally diagonal band segments having tear-open tabs include one of the band segments defining each respective one of the outer row container-receiving apertures, as well as one of the band segments defining each respective one of the container-receiving apertures of the inner row.

Preferably, in the second contemplated embodiment, the container-receiving apertures of each carrier define a rectangular array having two shorter sides and two longer sides, each shorter side being comprised of two such apertures, and each longer side being comprised of a larger number of such apertures. Each of the tear-open tabs may be thus accessible from one of the longer sides.

In either embodiment, if each tear-open tab on a diagonal band segment has generally parallel edges, such tear-open tab may have a slit spaced by a tearable bridge from one such edge, namely the edge that when the carrier stock is unstressed is closer to another diagonal band segment without a tear-open tab, to reduce problems associated with winding or unwinding of strips of carriers.

These and other objects, features, and advantages of this invention are evident from the following description of a preferred embodiment of this invention with reference to the accompanying drawings.

DETAILED DESCRIPTION OF PREFERRED EMBODIMENT

Figure 1:
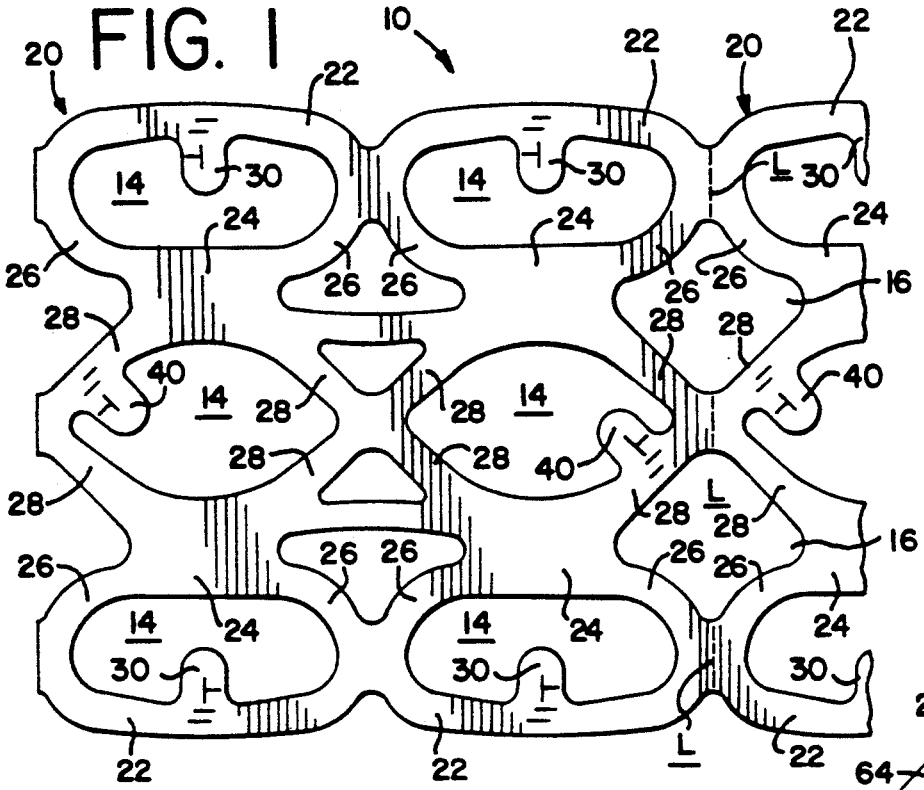
FIG. 1 is a fragmentary, plan view of a carrier severed from carrier stock according to a first contemplated embodiment of this invention.

In FIG. 1, carrier stock 10 according to a first contemplated embodiment of this invention is suitable for machine application to substantially identical containers (not shown) such as beverage cans of a type used commonly for beer, soft drinks, and other beverages. The carrier stock 10 is formed with separate apertures 14 in three longitudinal rows to receive the individual containers.

This invention is useful with cans, bottles, and other containers of various types. If the containers are cans of a type having a chime at one end or at each end, the carrier stock 10 can be machine applied to side walls of the containers so as to grip such walls at such chimes, or so as to grip such walls away from such chimes.

The carrier stock 10 is formed in an indeterminate length, as by die-cutting, from a single sheet of resilient polymeric material. A preferred material is low density polyethylene. A preferred thickness for such stock 10, if low density polyethylene is used, is about 16 mils.

The carrier stock 10 is severable along transverse lines L, so as to form individual carriers 20 that are substantially identical. In FIG. 1, one carrier 20 is shown completely, and another is shown fragmentarily. As shown in FIG. 1, the lines L may be perforated to facilitate severing the carrier stock 10.

The carrier stock 10 is formed, for each individual carrier 20, with integrally joined band segments defining six separate apertures 14 in a rectangular array with three longitudinal rows (two outer rows and an inner row) and two transverse ranks.

The band segments include outer segments 22 extending in a generally longitudinal direction when such stock 10 is unstressed, inner segments 24 extending similarly, curved band segments 26 included among the band segments defining the container-receiving apertures 14 in the outer rows, and generally diagonal segments 28 included among the band segments defining the container-receiving apertures 14 in the inner row. As shown, when the carrier stock 10 is unstressed, each generally diagonal segment 28 extends in a generally diagonal direction.

Each outer segment 22 is formed with a tear-open tab 30 extending in a generally transverse direction, into the container-receiving aperture 14 bounded partly by such outer segment 22 when the carrier stock 10 is unstressed. One generally diagonal segment 28 partly bounding each container-receiving aperture 14 in the middle row is formed with a tear-open tab 40 extending in a generally diagonal direction, into such container-receiving aperture 14, when the carrier stock 10 is unstressed.

The tear-open tabs 30, 40, are similar. Each may be similar to the tear-open tabs disclosed in Marco U.S. Pat. No. 5,020,661, the disclosure of which is incorporated herein by reference. Preferably, as shown in FIG. 2, in which an exemplary band segment 28 having an exemplary tear-open tab 40 is shown fragmentarily, each tear-open tab 40 and the diagonal band segment 28 formed with such tear-open tab 40 are slitted in a similar ? manner so as to have multiple slits, which facilitate tearing of such band segment 28 when such tear-open tab 40 is pulled.

Figure 2:
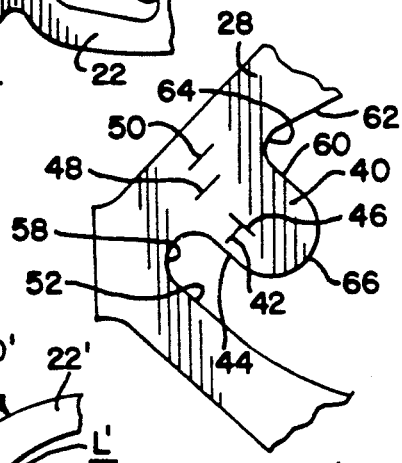
FIG. 2 is an enlarged, fragmentary detail of a band segment having a tear-open tab.

Preferably, as shown in FIG. 2, these slits are comprised of two slits formed in the tear-open tab 40 and two slits formed in the diagonal band segment having the tear-open tab 40. A first slit 42 is formed in the tear-open tab 40 so as to be generally perpendicular with a lateral edge 44 of such tab 40. The first slit 42 is spaced from the tab edge 44 by a tearable bridge defined by the first slit 42 and by the tab edge 44. A second slit 46 is formed in such tab 40 so as to be generally perpendicular to the first slit 42. The second slit 46 intersects the first slit 42. A third slit 48 and a fourth slit 50 are formed in the band segment 28 having the tear-open tab 40, as in Marco U.S. Pat. No. 5,020,661. The slits 48, 50, are formed in such segment 28 so as to be generally parallel with each other, so as to be generally perpendicular to the second slit 46, and so as to define tearable bridges between the second slit 46 and the third slit 48, between the third slit 48 and the fourth slit 50, and between the fourth slit and one of the additional apertures 16, namely an aperture that is bounded partly by the band segment 28 having the tear-open tab 40.

When the carrier stock 10 is unstressed, the tab edge 44 spaced from the first slit 42 by a tearable bridge, as noted above, is close to a portion of an edge 52 of the aperture 14 (into which the tear-open tab 40 extends) where the aperture edge 52 is defined by a diagonal band segment 28 without a tear-open tab 40. The tab edge 44 and the aperture edge 52 meet at a curved transition 58 to avoid a concentration of stresses. In contrast, an opposite edge 60 of the tear-open tab 40 defines a relatively large, acute angle with a portion of another edge 62 of the same aperture 14 where the aperture edge 62 is defined by the band segment 28 having such tab 40. The tab edge 60 and the aperture edge 62 meet at a curved transition 64 to avoid a concentration of stresses. The tab edges 44, 60, are generally parallel with each other and are connected by a curved edge 66 of the tear-open tab 40.

In the tear-open tabs 40, it is preferable to locate the slits 42, 46, near the tab edges 44, rather than near the tab edges 60. If the carrier stock 10 is wound on a core (not shown) for storage or shipment, some of the tear-open tabs 40 may tend to interlock with one another. If the slits 42, 46, were near the tab edges 60, rather than the tab edges 44, and if some of the tearable bridges were to be inadvertently torn, the slits 42 of some tabs 40 could interlock, which would interfere with efficient and effective winding or unwinding of the carrier stock 10.

In each carrier 20, the container-receiving apertures 14 define a rectangular array, which has two shorter sides each comprised of two such apertures 14 and two longer sides each comprised of three such apertures 14. Two of the tear-open tabs 30 are accessible to a user from each of the shorter sides. Each of the tear-open tabs 40 is accessible to a user from a respective one of the longer sides.

Figure 3:
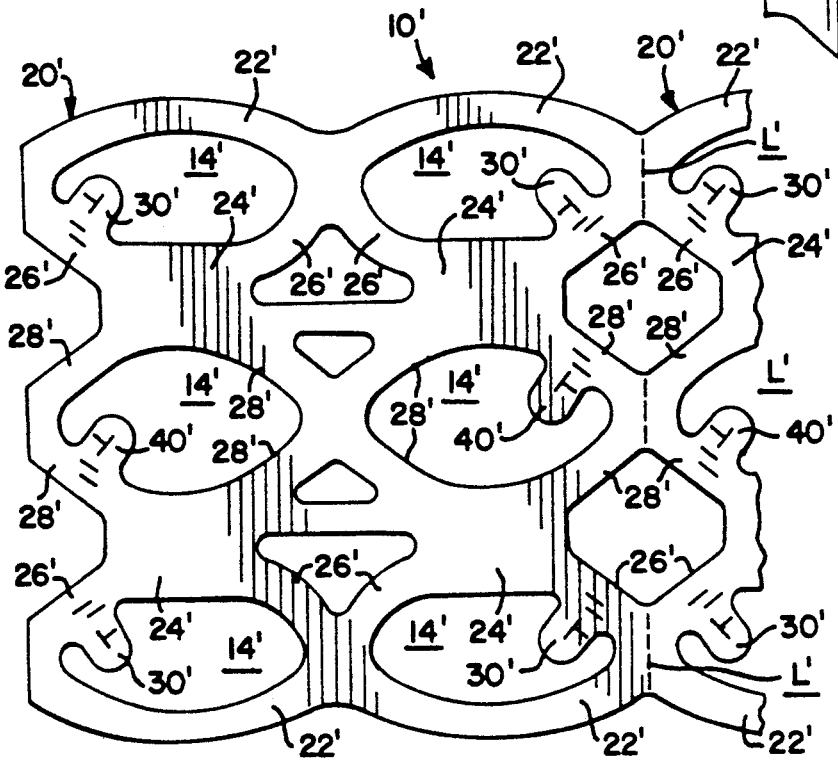
FIG. 3 is a fragmentary, plan view of a carrier severed from carrier stock according to a second contemplated embodiment of this invention.

In FIG. 3, carrier stock 10' according to a second contemplated embodiment of this invention is substitutable for the carrier stock 10 for machine application to substantially identical containers (not shown) similar to the containers discussed above. Except as illustrated in the drawings and described herein, the carrier stock 10' is similar to the carrier stock 10. Thus, the carrier stock 10' is severable along transverse lines L' (similar to the lines L discussed above) to form individual carriers 20' that are substantially identical.

The carrier stock 10' is formed, for each individual carrier 20', with integrally joined band segments defining six separate apertures 14' in a rectangular array with three longitudinal rows (two outer rows and an inner row) and two transverse ranks. The band segments include outer segments 22' extending in a generally longitudinal direction when such stock 10 is unstressed, inner segments 24' extending similarly, generally diagonal band segments 26' included among the band segments defining the container-receiving apertures 14 in the outer rows, and generally diagonal segments 28' included among the band segments defining the container-receiving apertures 14 in the inner row. As shown, when the carrier stock 10' is unstressed, each generally diagonal segment 26', 28', extends in a generally diagonal direction.

One generally diagonal segment 26' at each container-receiving aperture 14' in each outer row is formed with a tear-open tab 30' extending in a generally transverse direction, into such container-receiving aperture 14', when the carrier stock 10' is unstressed. One generally diagonal segment 28' at each container-receiving aperture 14' in the middle row is formed with a tear-open tab 40' extending in a generally diagonal direction, into such container-receiving aperture 14', when the carrier stock 10' is unstressed.

The tear-open tabs 30', 40', are similar, each being similar to the tear-open tabs 30, 40, described above and to the tear-open tabs disclosed in Marco U.S. Pat. No. 5,020,661. Further, each tear-open tab 30, 40, and the and segment 22, 28, formed with such tear-open tab 30, 40, are slitted in a similar manner so as to have multiple slits, which are similar to the slits described above and which facilitate tearing of such band segment 22, 28, when the tear-open tab is pulled.

In each carrier 10', the container-receiving apertures 14' define a rectangular array, which has two shorter sides each comprised of two such apertures 14' and two longer sides each comprised of three such apertures 14'. Two of the tear-open tabs 30' and one of the tear-open tabs 40' are accessible to a user from each longer side.

Various modifications may be made in either embodiment described above without departing from the scope and spirit of this invention.

I claim:

1. Carrier stock for machine application to substantially identical containers, said stock being formed from a single sheet of resilient polymeric material and being severable along transverse lines to form individual carriers with container-receiving apertures in longitudinal rows to receive the individual containers, said carrier stock being formed for each individual carrier with integrally joined band segments defining the container-receiving apertures, the band segments including generally diagonal band segments, each of which extends in a generally diagonal direction when said stock is unstressed and some of which have tear-open tabs.

2. The carrier stock of claim 1 wherein the longitudinal rows include two outer rows and an inner row and wherein the generally diagonal band segments having tear-open tabs include one of the band segments defining each respective one of the container-receiving apertures of the inner row.

3. The carrier stock of claim 2 wherein the band segments include outer band segments extending in a generally longitudinal direction when said stock is unstressed, each outer band segment also having a tear-open tab.

4. The carrier stock of claim 3 wherein the container-receiving apertures of each carrier define a rectangular array having two shorter sides and two longer sides, each shorter side being comprised of two such apertures, each longer side being comprised of a larger number of such apertures, and wherein two of the tear-open tabs are accessible from each of the shorter sides, and wherein each of the remaining tear-open tabs is accessible from one of the longer sides.

5. The carrier stock of claim 1 wherein each tear-open tab has generally parallel edges and each tear-open tab on a diagonal band segment has a slit spaced by a tearable bridge from one such edge, namely the edge that when the carrier stock is unstressed is closer to another diagonal band segment without a tear-open tab.

6. The carrier stock of claim 2 wherein the generally diagonal band segments having tear-open tabs include one of the band segments defining each respective one of the outer row of container-receiving apertures.

7. The carrier stock of claim 6 wherein the container-receiving apertures of each carrier define a rectangular array having two shorter sides and two longer sides, each shorter side being comprised of two such apertures, each longer side being comprised of a larger number of such apertures, and wherein each of the tear-open tabs is accessible from one of the longer sides.

8. The carrier stock of claim 7 wherein each band segment having a tear-open tab is slitted to facilitate tearing of such band segment when the tear-open tab is pulled.

* * * * *

UNITED STATES PATENT AND TRADEMARK OFFICE

CERTIFICATE OF CORRECTION

PATENT NO. : 5,255,780

DATED : October 26, 1993

INVENTOR(S) : Robert C. Olsen

It is certified that error appears in the above-indentified patent and that said Letters Patent is hereby corrected as shown below:

Column 3, line 47, at beginning of line, the "?" should be deleted.
Column 5, line 11, before "segment", --and-- should be deleted and --band-- should be inserted.

Signed and Sealed this

Nineteenth Day of April, 1994

Bruce Lehman

*Attest:*

BRUCE LEHMAN

*Attesting Officer*

*Commissioner of Patents and Trademarks*